US006224246B1

(12) United States Patent
Natsume et al.

(10) Patent No.: US 6,224,246 B1
(45) **Date of Patent: *May 1, 2001**

(54) SIGNAL LAMP FOR VEHICLES

(75) Inventors: Kazunori Natsume; Hideaki Satsukawa, both of Shizuoka (JP)

(73) Assignee: Koito Manufacturing Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/136,963

(22) Filed: Aug. 20, 1998

(30) Foreign Application Priority Data

Mar. 18, 1998 (JP) ..... 10-089323

(51) Int. Cl.[7] ..... F21W 101/02

(52) U.S. Cl. ..... 362/518; 362/346; 362/348; 362/517; 362/297

(58) Field of Search ..... 362/518, 346, 362/348, 517, 297

(56) References Cited

U.S. PATENT DOCUMENTS 3,857,029 * 12/1974 Krinke ..... 362/518
4,351,018 * 9/1982 Fratty ..... 362/215
4,506,315 * 3/1985 Maekawa et al. ..... 362/518
4,994,947 * 2/1991 Fresko ..... 362/297
5,003,435 * 3/1991 Nakata ..... 362/61
5,055,981 * 10/1991 Nino ..... 362/518
5,526,247 * 6/1996 Suigiyama ..... 362/268
5,556,194 9/1996 Natsume et al. ..... 362/299
5,876,114 * 3/1999 Nino ..... 362/518
6,019,492 * 2/2000 Ikegaya et al. ..... 362/521
6,045,245 * 4/2000 Kanou ..... 362/518

* cited by examiner

*Primary Examiner*—Sandra O'Shea
*Assistant Examiner*—Anabel M. Ton
(74) *Attorney, Agent, or Firm*—Sughrue, Mion, Zinn, Macpeak & Seas, PLLC

(57) ABSTRACT

A signal lamp for vehicles has a reflector that acts to diffuse light from a light source within the lamp. The reflector is made up of multiple diffusing reflective elements having a reflecting region that reflects light emitted from the light source in a direction of an optical axis of the lamp. A lens is positioned in front of the reflector. The reflecting region of each diffusing reflective element is varied, such that an area ratio of the reflecting region for portions of the reflector with a high reflective illuminance is less than other portions having lower illuminance.

13 Claims, 13 Drawing Sheets

SIGNAL LAMP FOR VEHICLES

BACKGROUND OF THE INVENTION

1. Field of the Invention

The present invention relates to a signal lamp for vehicles, the reflective surface of which is composed of a plurality of reflecting elements. More particularly, the present invention relates to a structure of a reflective surface which improves in external appearance.

2. Related Art

As shown in FIGS. 12 to 14, a conventional signal lamp for vehicles is generally provided with a light source bulb 2, a reflector 4 having a reflective surface 4*a* for reflecting light forward sent from the light source bulb 2 and a lens 6 arranged in the front of the reflector 4.

Recently, many of signal lamps for vehicle are composed as follows. As shown in each drawing, the reflective surface 4*a* is composed of a plurality of diffusing reflection elements 4*s*, so that the burden imposed on the light diffusing function of lens steps 6*s* formed on the inner surface of the lens 6 can be reduced. Due to the foregoing, it becomes possible to ensure a feeling of transparency and depth of the lighting device.

However, the following problems may be encountered in the conventional signal lamp for vehicles described above. When the lighting device is viewed from the front side under the condition that the light source bulb 2 is turned on, brightness of the reflecting light, which has been reflected in a portion on the reflective surface 4*a*, greatly changes depending upon the portion. Due to the foregoing, the lighting device looks unattractive when viewed from the outside.

The above problem will be explained in detail as follows. For example, as shown in FIGS. 13 and 14, when each diffusing reflection element 4*s* has a light diffusing function in the transverse direction, and on the other hand when it has no light diffusing function in the vertical direction, only light reflected in the central region of the light diffusing reflection element 4*s* in the transverse direction is sent to the direction of the optical axis Ax of the reflector. Therefore, when the lighting device is observed from the front side under the condition that the light source bulb 2 is turned on, the rectangular central region 4*s*1 of each light diffusing reflection element 4*s* in the transverse direction, that is, the optical axis direction reflecting region is seen as a belt-shaped bright portion B, the brightness of which is high as shown in FIG. 15. However, luminance of this bright portion B is different from each other according to the position at which the diffusing reflection element 4*s* is arranged as shown by the mesh in the drawing.

That is, in the light diffusing reflection element 4*s* distant from the filament 2*a* (light source) of the light source bulb 2, illuminance of the incident light emitting from the filament 2*a* becomes low. Therefore, luminance of the bright portion B of the light diffusing reflection element 4*s* also becomes low. In the case of a linear light source such as the filament 2*a* described above, the light distribution characteristics (spatial distribution of luminous intensity) are described as follows as shown in FIGS. 16(*a*) and 16(*b*). Luminous intensity in a direction close to the central axis Axf of the filament 2*a* is lower than luminous intensity in a direction perpendicular to the central axis Axf.

Therefore, in the case where the filament 2*a* extends in the perpendicular direction as shown in FIG. 15, even if the distance from the filament 2*a* is the same, illuminance of the diffusing reflection element 4*s* located in the upper or lower position of the optical axis Ax is lower than illuminance of the diffusing reflection element 4*s* located on the side of the optical axis Ax when light emitting from the filament 2*a* is incident. For the above reasons, when the entire reflective surface 4*a* is observed, a portion close to the side of the optical axis Ax is very bright, however, a peripheral portion is very dark, that is, brightness of the entire reflective surface 4*a* is not uniform. Due to the foregoing, the lighting device looks unattractive.

SUMMARY OF THE INVENTION

The present invention was accomplished to solve the foregoing problems accompanying the conventional signal lamp for vehicles. An object of the present invention is to provide a signal lamp for vehicles, the external appearance of which can be improved in the case of turning on the light source bulb.

According to the present invention, light emitted from a light source is incident on reflecting elements of the lamp reflector, where the reflecting elements are different distances from the light source, and the higher the illuminance of a reflecting element, caused by the incident light, the lower the area ratio of the region of the element causing reflection in the optical axis direction is set to be.

The above and other objects can be accomplished by a provision of a signal lamp for vehicles which, according to the present invention, includes: a light source; a reflector having a reflective surface for reflecting light forward emitting from the light source, the reflective surface being composed of a plurality of diffusing reflection elements each comprising a reflecting region which reflects light emitting from the light source in the optical axis direction, the area ratio of the reflection region, where the illuminance of the reflecting element with respect to the incident light emitting from the light source is high, being lower than the others where the illuminance of which is low; and a lens arranged in the front of the reflector.

The diffusing reflection element may be an element in which light is diffused and reflected only in one direction. Alternatively, the diffusing reflection element may be an element in which light is diffused and reflected in two directions. An external shape and a surface shape of the above diffusing reflection element are not particularly limited to a specific embodiment.

Concerning the illuminance of the incident light emitting from the light source, as long as it can be measured by the same reference for each diffusing reflection element, the value of illuminance is not particularly limited. For example, it is possible to adopt the mean value of illuminance at each point of the diffusing reflection element, illuminance of the center of the diffusing reflection element, and illuminance of the point of the diffusing reflection element located closest to the optical axis.

As shown in the arrangement described above, the reflective surface of the reflector of the signal lamp for vehicles of the present invention is composed of a plurality of diffusing reflection elements. According to the present invention, the higher the illuminance of a reflecting element with respect to the incident light emitting from the light source is, the lower the area ratio of the optical axis direction reflecting region is set to be. Therefore, the following action effects can be provided.

When the lighting device is observed from the front side under the condition that the light source is turned on, the optical axis direction reflecting region of each diffusing reflection element is bright because it becomes a bright portion. However, illuminance of the incident light emitting from the light source is different according to a distance from the light source to the diffusing reflection element, and also according to a shape and arrangement of the light source. Therefore, luminance of the above bright portion is generally different between the diffusing reflection elements.

In the present invention, the higher the illuminance of a reflecting element with respect to the incident light emitting from the light source is, the lower the area ratio of the optical axis direction reflecting region is set to be. Therefore, although luminance itself of the above bright portion is not changed, an area of the bright portion is reduced in inverse proportion to the luminance. Due to the foregoing, even when luminance of the bright portion is different between the diffusing reflection elements, the luminous intensity of each diffusing reflection element can be made uniform between the diffusing reflection elements. Due to the foregoing, the entire reflective surface can be made to be seen as if each diffusing reflection element were bright at a substantially uniform brightness.

Therefore, according to the present invention, in a signal lamp for vehicles, the reflective surface of which is composed of a plurality of diffusing reflection elements, it is possible to improve the external appearance of the lighting device when the light source bulb is turned on and viewed from the outside.

In the above structure, the area of the bright portion is reduced in inverse proportion to the luminance of the portion. This structure is not particularly limited, that is, a specific structure, where the higher the illuminance of a reflecting element with respect to the incident light emitting from the light source is, the lower the area ratio of the optical axis direction reflecting region is set to be. For example, it is possible to adopt a structure in which a portion of an optical axis direction non-reflecting region of each diffusing reflection element, which is a region except for the optical axis direction reflecting region, is formed into a light non-reflecting region in which light emitting from the light source is not reflected forward. As a specific structure of the above light non-reflecting region, it is possible to adopt a structure in which a reflective surface treatment such as aluminum vapor-deposition is not conducted, and also it is possible to adopt a structure in which a reflective surface treatment is conducted, or alternatively, the reflective surface is made to be a frosted surface which is substantially equal to a complete diffuse surface.

Another structure may also be applicable if desired, as described in the following. A portion of an optical axis direction non-reflecting region of each diffusing reflection element, which is a region except for the optical axis direction reflecting region, is formed into a deflection diffusion reflecting region in which light emitting from the light source is diffused and reflected in a direction different from a direction of other region in the optical axis direction non-reflecting region. When the above structure is adopted, diffusing reflection light emitting from a portion of the region can be effectively utilized for the light distribution of the lighting device. Due to the foregoing, the burden imposed on the diffusing function of the lens can be further reduced.

In the above structure, the optical axis direction reflecting region of each diffusing reflection element is composed of the same curved surface as that of the other region in the optical axis direction non-reflecting region. Due to the above structure, not only when the lighting device is observed from the front side of the lighting device (in the optical axis direction) but also even when the lighting device is observed from a visual point a little shifted from the front side of the lighting device, the diffusing reflection elements can be seen as if they were bright at a substantially uniform brightness.

As described before, the external shape of each diffusing reflection element is not limited to the specific embodiment. For example, when the diffusing reflection elements are arranged at substantially regular intervals, it is effective to adopt the structure of the present invention because a person who observes the lighting device may have a feeling of incongruity when brightness of the diffusing reflection element is different from each other.

BRIEF DESCRIPTION OF THE DRAWINGS

FIG. 5 is a view showing a external appearance of the reflective surface when the reflector is viewed from the front in the direction of the optical axis in the first embodiment under the condition that the light source bulb is turned on;

FIG. 6 is a cross-sectional side view showing a signal lamp for vehicles of the second embodiment, wherein FIG. 6 is a view drawn in the same manner as that of FIG. 3;

FIG. 7 is a view showing a look of the reflective surface when the reflector is observed from the front in the direction of the optical axis in the second embodiment under the condition that the light source bulb is turned on;

FIG. 11 is a view showing an external appearance of the reflective surface when the reflector is viewed from the front in the direction of the optical axis according to the third embodiment under the condition that the light source bulb is turned on;

FIG. 15 is a view showing an external appearance of the reflective surface when the reflector is viewed from the front in the direction of the optical axis in the conventional example under the condition that the light source bulb is turned on.

DESCRIPTION OF THE PREFERRED EMBODIMENTS

Referring to the accompanying drawings, preferred embodiments of the present invention will be explained below.

First, a first embodiment of the present invention will be explained below with reference to FIGS. 1–5.

Figure 1:
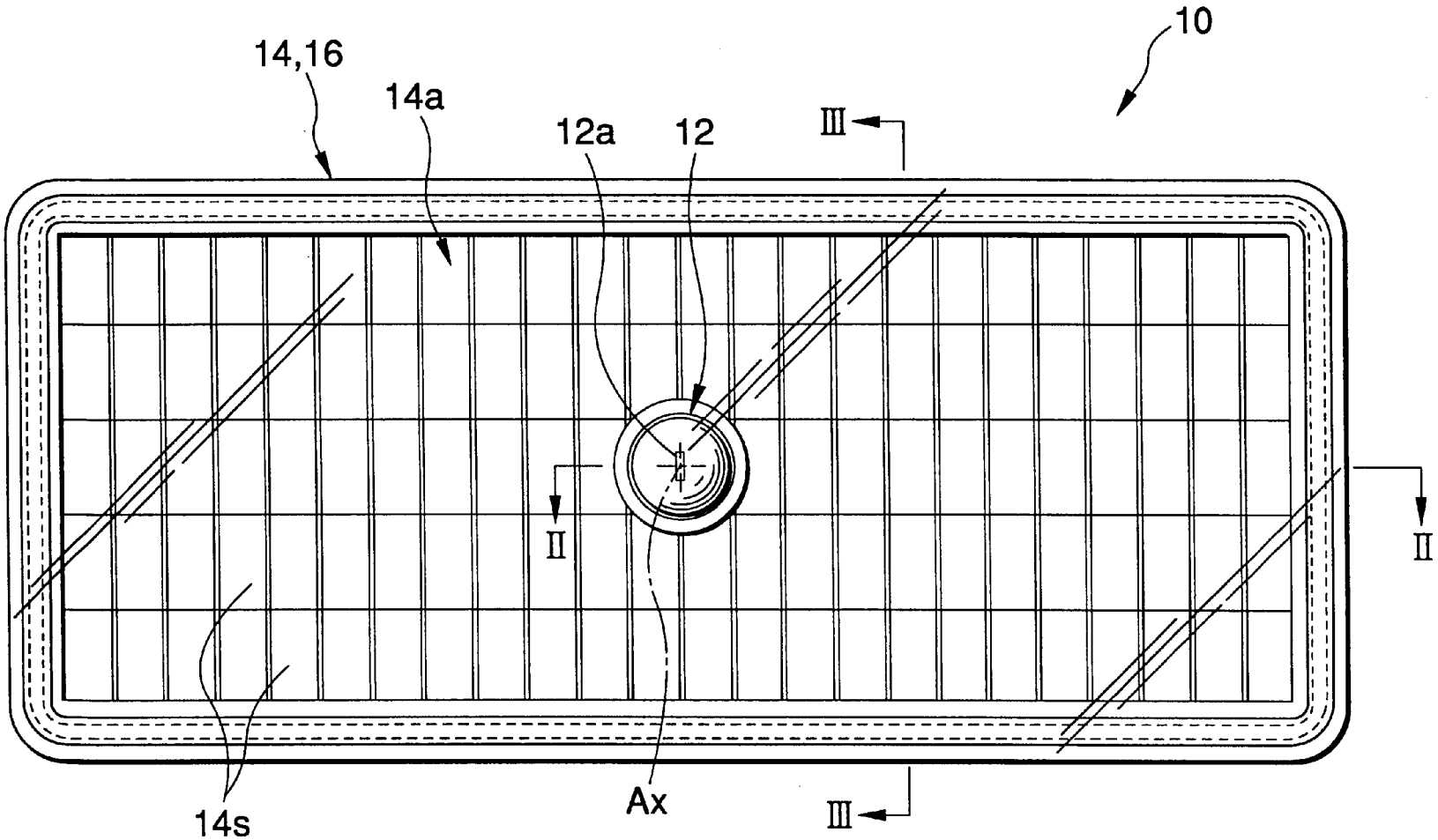
FIG. 1 is a front view showing a signal lamp for vehicles of the first embodiment of the present invention.
Figure 2:
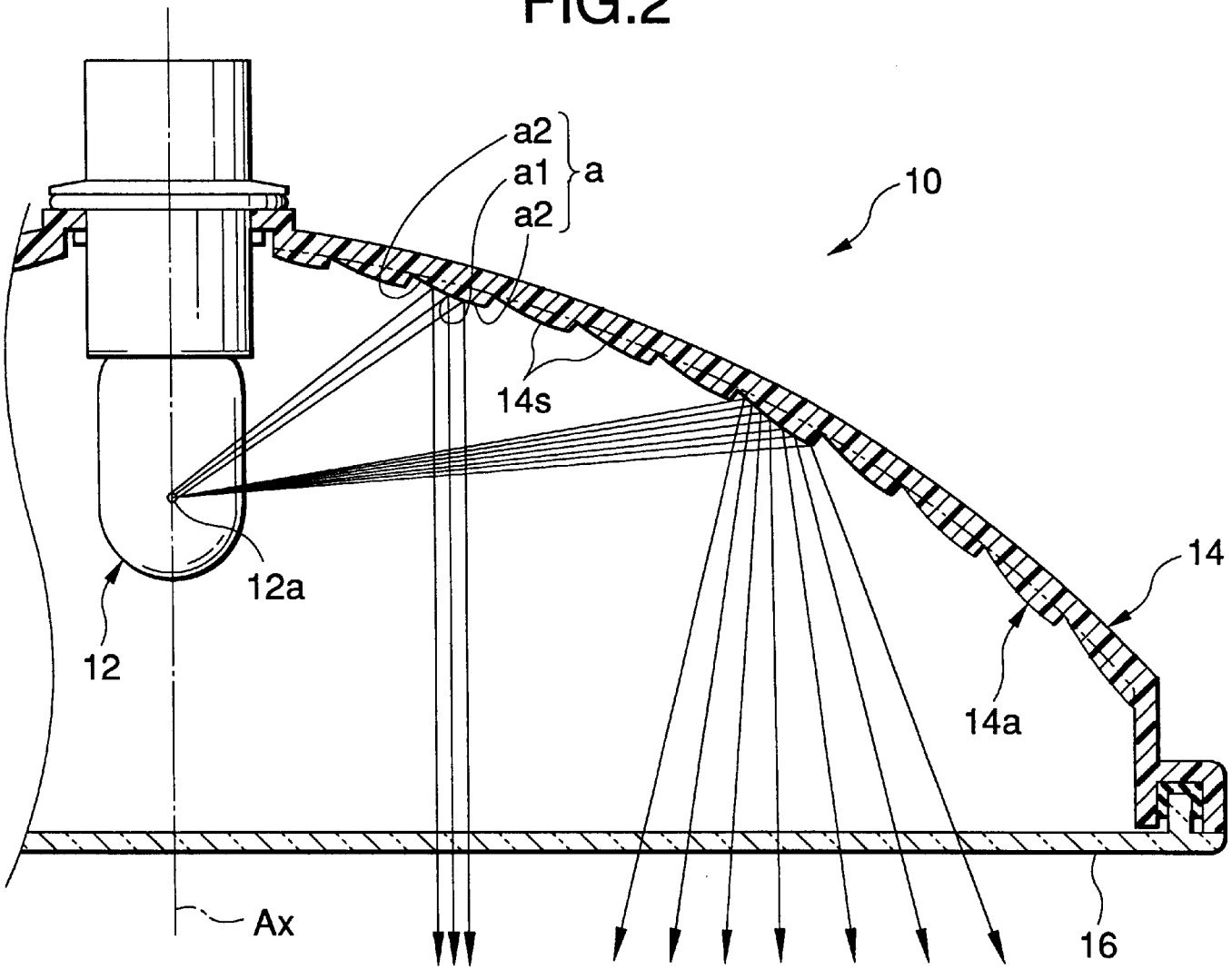
FIG. 2 is a cross-sectional view taken on line II—II in FIG. 1.
Figure 3:
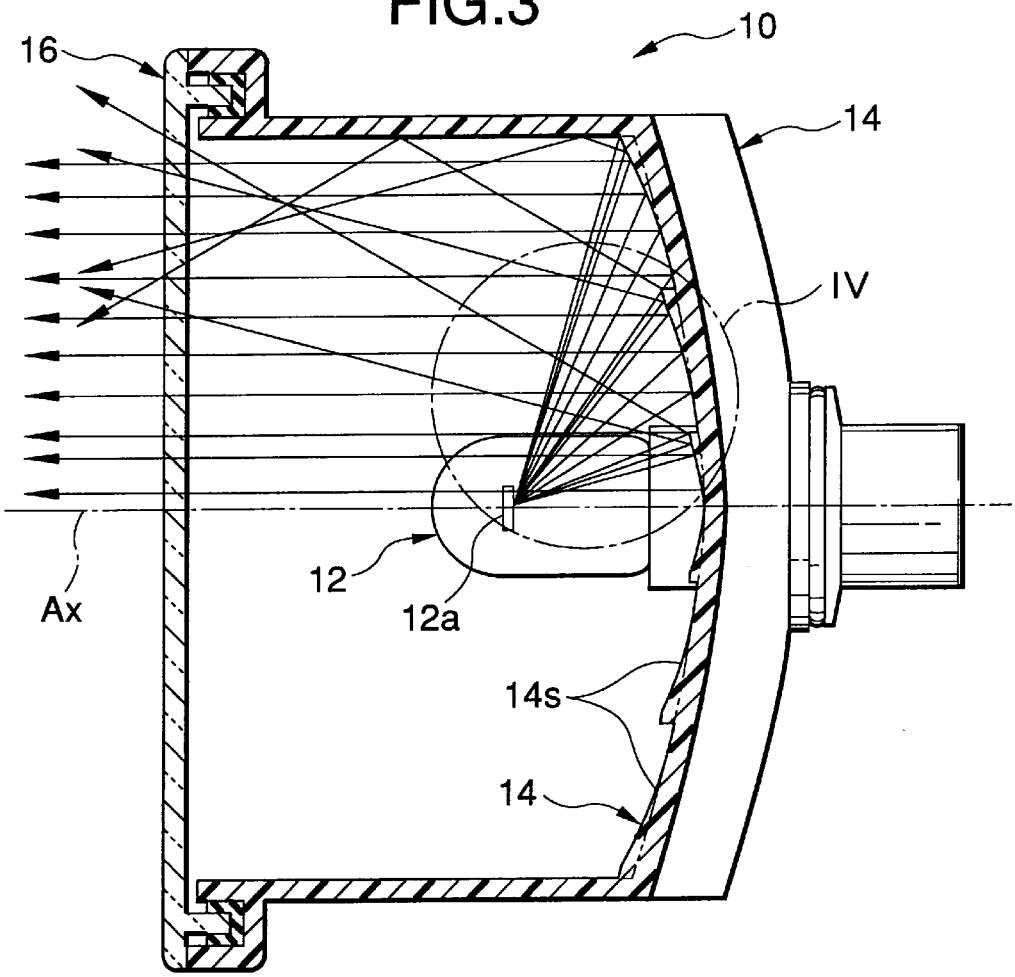
FIG. 3 is a cross-sectional view taken on line III—III in FIG. 1.
Figure 4:
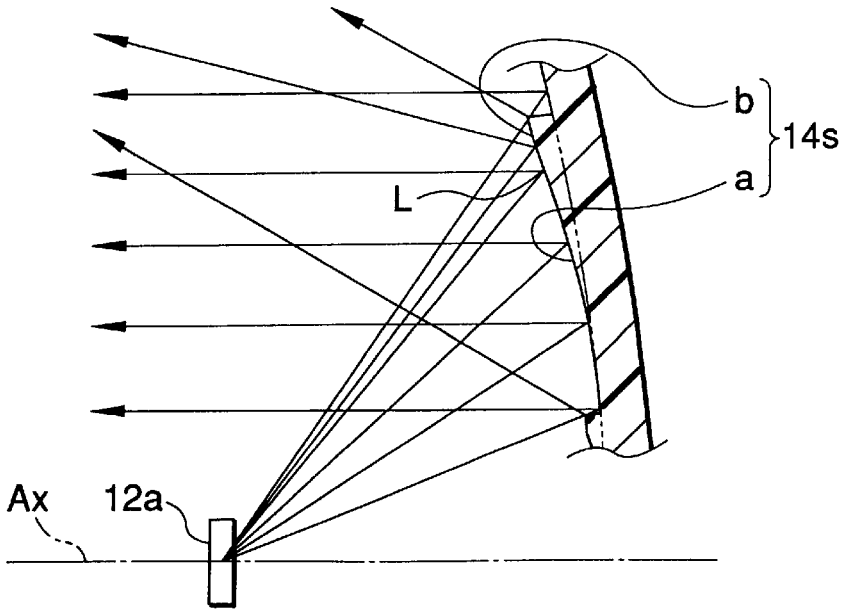
FIG. 4 is a view showing a portion IV of FIG. 3 in detail.

FIG. 1 is a front view showing a signal lamp for vehicles according to the first embodiment of the present invention. FIG. 2 is a cross-sectional view taken on line II—II in FIG. 1, and FIG. 3 is a cross-sectional view taken on line III—III in FIG. 1. FIG. 4 is a view showing a portion IV of FIG. 3 in detail.

As shown in these drawings, a signal lamp 10 for vehicles of the first embodiment is a rectangular tail lamp which is long in the transverse direction. The signal lamp 10 for vehicles includes: a light source bulb 12; a reflector 14 having a reflective surface 14*a* on which light emitting from a filament 12*a* (light source) of the light source bulb 12 is reflected frontward (It is the front side of the lighting device, however, it is the rear side of the vehicle. These circumstances are the same in the following sentences.); and a lens 16 arranged in the front of this reflector 14.

The above reflector 14 is provided with an optical axis Ax extending to the longitudinal direction. The light source bulb 12 is attached to the reflector 14 in such a manner that a center of the filament 12*a* extending in the perpendicular direction is positioned on the optical axis Ax. The lens 16 is composed of a transparent lens.

The reflective surface 14*a* of the reflector 14 is composed of a plurality of rectangular diffusing reflection elements 14*s* which are arranged at regular intervals in a lattice-shape. Surface shapes of the diffusing reflection elements 14*s* are formed when the following curved surfaces are formed on a plurality of paraboloids of revolution, the focuses of which are located at the center of the filament 12*a*, and the focal distances of which are different from each other, wherein the central axis of each paraboloid of revolution is the optical axis Ax.

As shown in FIG. 2, the horizontal section of each diffusing reflection element 14*s* is set to be a convex curve. Due to the foregoing, light emitting from the filament 12*a* is reflected being diffused at a predetermined diffusion angle onto the right and left with respect to the optical axis Ax. In this connection, the radius of curvature of the convex curve is set at a substantially constant value for each diffusing reflection element 14*s*.

On the other hand, as shown in FIGS. 3 and 4, a perpendicular cross section of each diffusing reflection element 14*s* is set to be the same curve as the perpendicular cross-sectional shape of each paraboloid of revolution in its general region "a". The end region "b" located in the opposite side to the general region "a" with respect to the optical axis is set at a convex curve which smoothly continues to the curve of the general region "a". Due to the foregoing, light emitting from the filament 12*a* is reflected on the general region "a" as a flux of parallel rays in the direction of the optical axis Ax, and at the same time, light emitting from the filament 12*a* is reflected on the end region "b" so that it can be diffused in a direction separate from the optical axis Ax. In this connection, in the diffusing reflection element 14*s* located at an upper position of the optical axis Ax, the end region "b" is formed in its upper end portion. In the diffusing reflection element 14*s* located at a lower position of the optical axis Ax, the end region "b" is formed in its lower end portion. In the diffusing reflection element 14*s* located at the same height as that of the optical axis Ax, the end region "b" is formed in both the upper and the lower end portion.

Due to the foregoing, in each diffusing reflection element 14*s*, only light reflected on the central region a1 in the transverse direction in the general region "a" is reflected in the direction of the optical axis Ax. That is, the central region a1 in the transverse direction of the general region "a" becomes an optical axis direction reflecting region, and the region a2 in the general region "a" except for the central region a1 in the transverse direction and the end region "b" become an optical axis non-reflecting region.

The higher the illuminance of the diffusing reflection element with respect to the incident light emitting from the filament 12*a* is, the lower the area ratio of the optical axis direction reflecting region a1 in each diffusing reflection element 14*s* is set to be. The more distant the diffusing reflection element 14*s* is from the filament 12*a* of the light source bulb 2, the lower the value of illuminance decreases. Since the filament 12*a* is a linear light source extending in the perpendicular direction, even if the distances from the filament 12*a* are equal to each other, the value of illuminance of the diffusing reflection element 14*s* located at a position upper or lower the optical axis Ax becomes lower than the value of illuminance of the diffusing reflection element 14s located at the side of the optical axis. Therefore, the area ratio of the optical axis direction reflecting region a1 of the diffusing reflection element 14*s* located at the side of the optical axis Ax is smallest and gradually becomes higher when the diffusing reflection element 14*s* is separated from the optical axis Ax. Specifically, when the boundary L between the general region "a" and the end region "b" is set at a different position according to each diffusing reflection element 14*s*, the ratio of area can be adjusted.

Next, operation of the first embodiment will be explained below.

Figure 5:
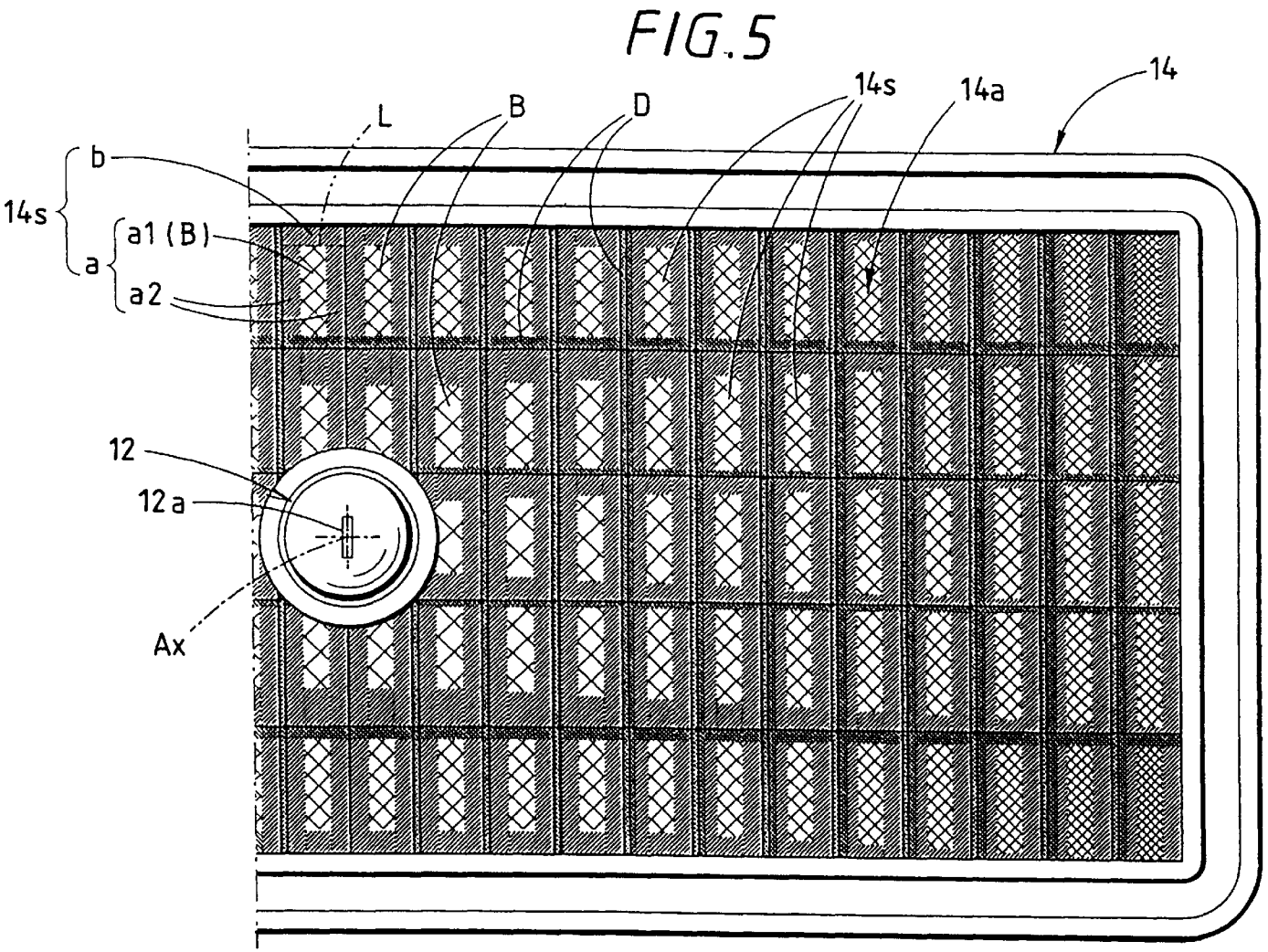

FIG. 5 is a view showing a look of the reflective surface 14*a* when the reflector 14 is viewed from the front in the direction of the optical axis Ax under the condition that the light source bulb 12 is turned on.

As apparent from FIG. 5, in each diffusing reflection element 14*s*, the optical axis direction reflecting region al is bright as a belt-shaped bright portion B, however, the optical axis direction non-reflecting region a2 and the end region "b" are not bright. In this connection, the densely hatched lattice-shaped region D in the view is a step portion formed between the diffusing reflection elements 4*s*, and it is also a light non-incident region upon which light emitting from the filament 2*a* is not incident because it is shaded by the step portion.

Luminance of the bright portion B is different as shown by the mesh in the view according to a position at which each diffusing reflection element 14*s* is arranged. This difference in luminance corresponds to a difference in illuminance of the incident light emitting from the filament 12*a* of the light source bulb 2. Luminance of the bright portion B of the diffusing reflection element 14*s* located at the side of the optical axis Ax close to it is highest, and luminance of the bright portion B of the diffusing reflection element 14*s* distant from the optical axis Ax is gradually decreased.

However, as described before, the ratio of area of the optical axis direction reflecting region a1 of the diffusing reflection element 14*s* located at the side of the optical axis Ax is lowest and gradually increases when it is separated from it. Therefore, luminous intensity of the bright portion B is made uniform between the diffusing reflection elements 14*s*. Due to the foregoing, when the reflective surface 14*a* is viewed from the front of the optical axis Ax, each diffusing reflection element 14*s* looks bright substantially uniformly.

Therefore, according to the present embodiment, in a signal lamp for vehicles, the reflective surface of which is composed of a plurality of diffusing reflection elements, it is possible to enhance a looks of the lighting device when the light source bulb is turned on.

Particularly, in-this embodiment, the diffusing reflection elements 14*s* are arranged at regular intervals in a lattice-shape. Therefore, when the diffusing reflection elements are bright differently, the lighting device may have a feeling of incongruity. However, it is possible to effectively solve the problem of having a feeling of incongruity. Further, in this embodiment, each diffusing reflection element 14*s* has a function of diffusing in the transverse direction, and the end region "b" has a function of diffusing in the perpendicular direction. Therefore, it is possible for the reflector 14 to satisfy a predetermined light distribution performance required for the lighting device. Due to the foregoing, the lens 16 can be composed of a plain-glass lens, so that a feeling of transparency and depth can be improved.

In the first embodiment, the optical axis direction reflecting region a1 composing the general region "a" of each diffusing reflection element 14*s*, and the region a2 except for that are formed by the same curved surface. Due to the above structure, not only when the lighting device is observed from the front side of the lighting device (in the optical axis Ax direction) but also even when the lighting device is observed from a visual point a little shifted from the front side of the lighting device in the transverse direction, the diffusing reflection elements can be seen as if they were bright at a substantially uniform brightness.

Next, a second embodiment of the present invention will be explained below with reference to FIGS. 6 and 7.

Figure 6:
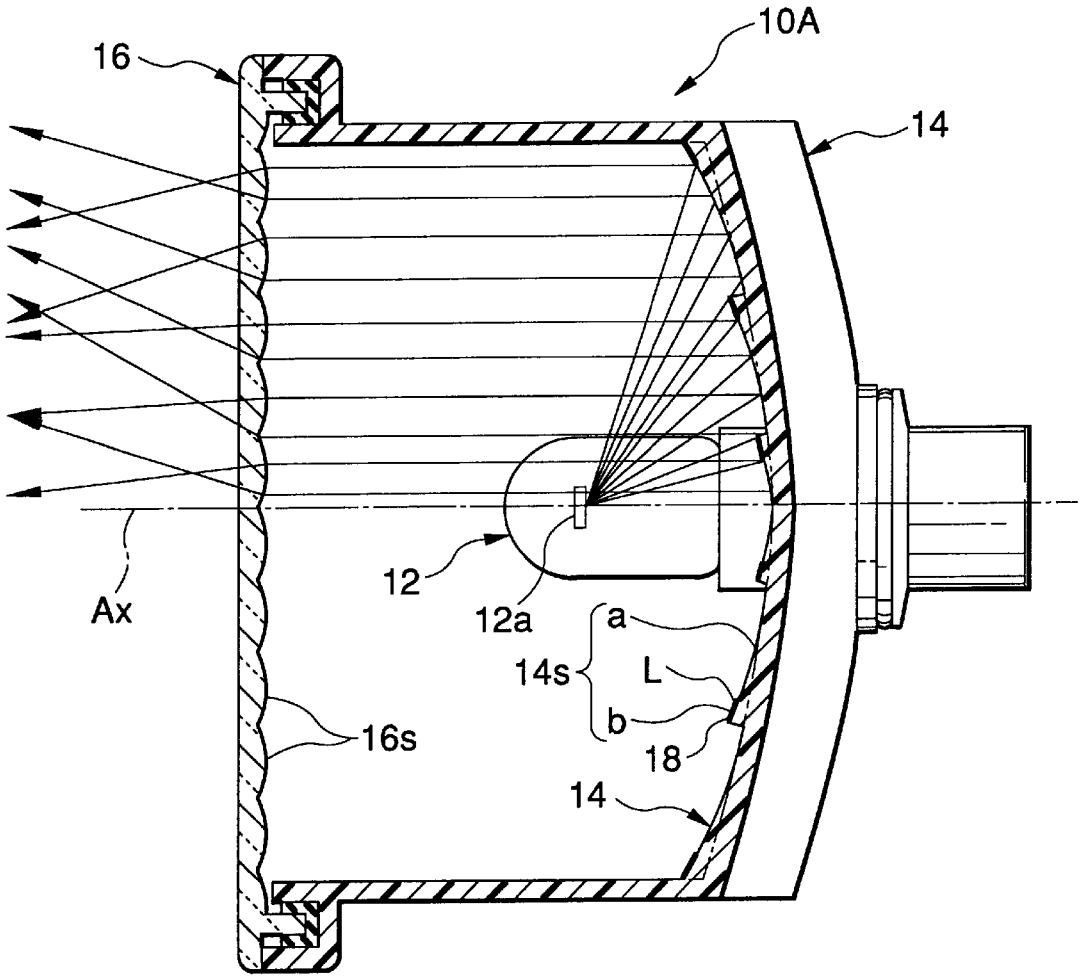
Figure 7:
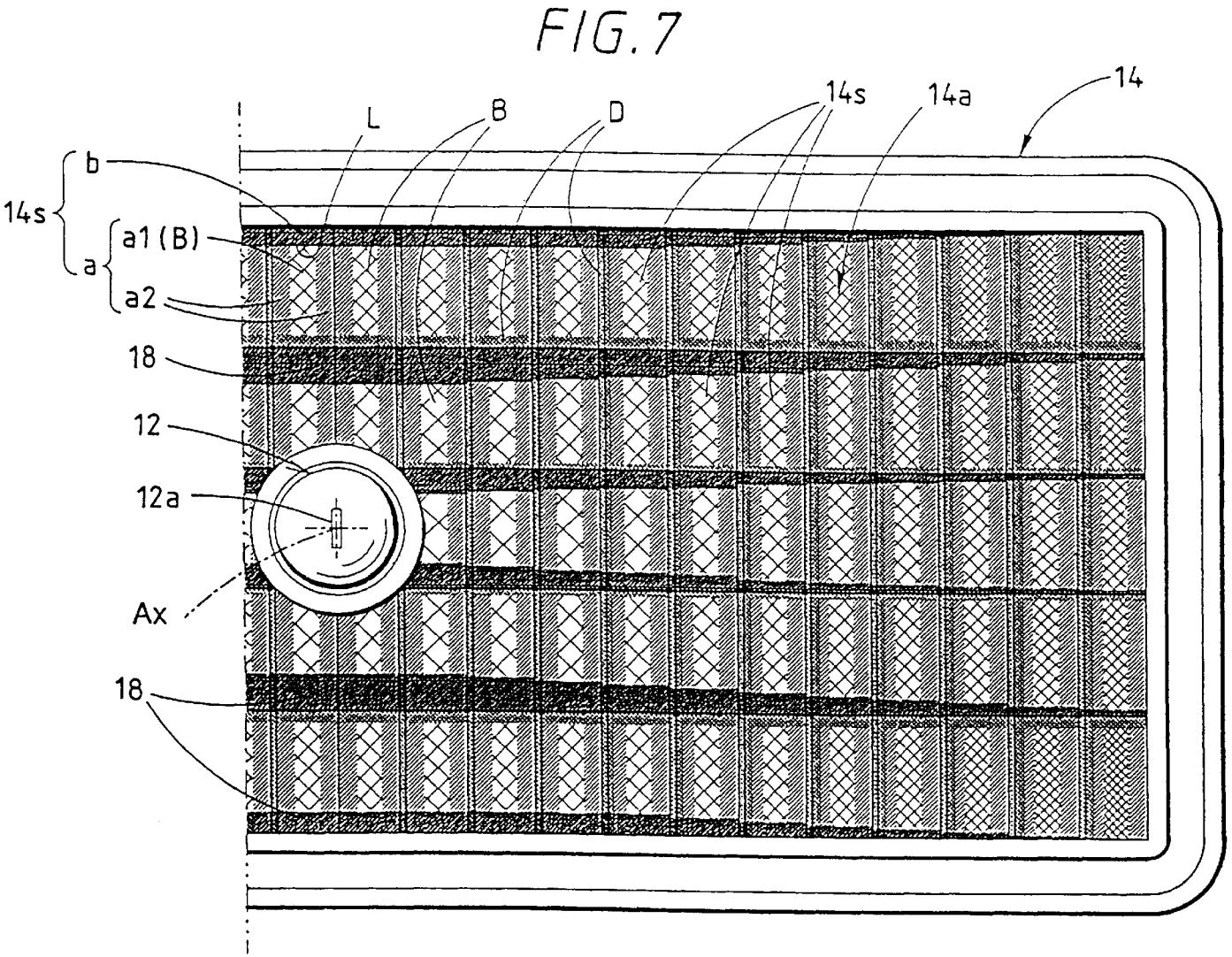

FIG. 6 is a cross-sectional side view showing a signal lamp for vehicles of the second embodiment. FIG. 6 is a view drawn in the same manner as that of FIG. 3.

As shown in the drawing, the structure of the end region "b" of each diffusing reflection element 14*s* of the signal lamp 10A for vehicles of the second embodiment is different from that of the signal lamp 10 for vehicles of the first embodiment described before. In this embodiment, a perpendicular section of the end region "b" is formed by extending the general region "aa" as it is. On a surface of the end region "b", there is provided a non-reflecting coating film 18. In this connection, a position of the boundary line L between the general line "a" and the end region "b" is the same as that of the first embodiment.

Even when the light source bulb 12 is turned on, light emitting from the filament 12*a* is not reflected on the end region "b" on which the non-reflecting coating film is provided. Therefore, as shown in FIG. 7, when the above reflector 14 is observed from the front of the optical axis Ax, only the optical axis direction reflecting region a1 of each diffusing reflection element 14*s* looks bright as a belt-shaped bright portion B.

Accordingly, in the same manner as that of the first embodiment, when the reflective surface 14*a* is observed from the front of the optical axis Ax, each diffusing reflection element 14*s* also looks bright substantially uniformly in the second embodiment.

However, unlike the first embodiment described before, the end region "b" has no function of diffusing and reflecting in the perpendicular direction in this embodiment. Accordingly, as shown in FIG. 6, it is necessary to provide lens steps for diffusion in the perpendicular direction in the lens 16.

In this connection, instead of providing the non-reflecting coating film 18, the reflective surface processing (aluminum vapor-deposition) may not be conducted. Due to the foregoing, the same action and effect as that of the second embodiment can be provided.

Next, a third embodiment of the present invention will be explained below with reference to FIGS. 8 to 11.

Figure 8:
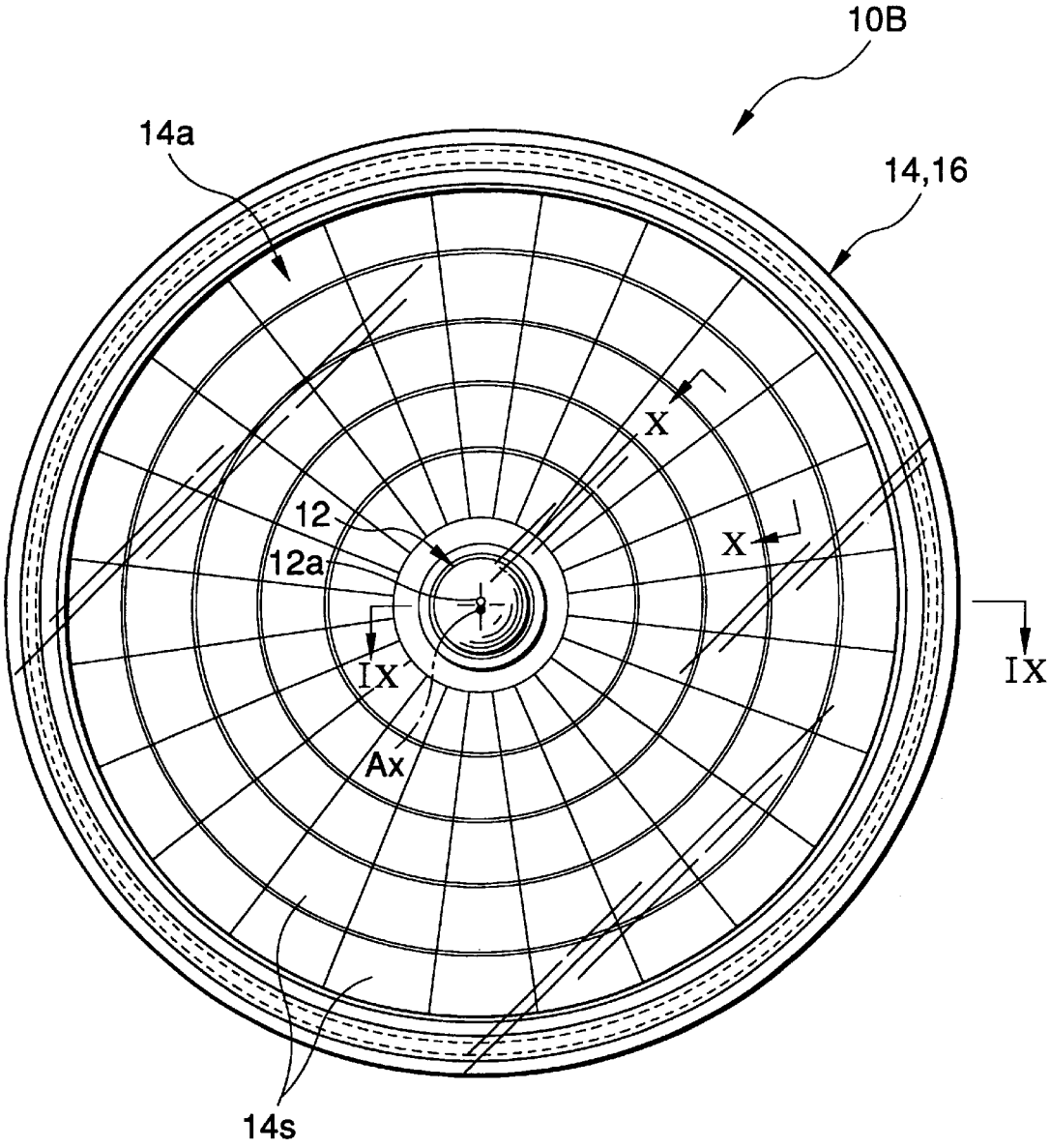
FIG. 8 is a front view showing a signal lamp for vehicles according to the third embodiment of the invention.
Figure 9:
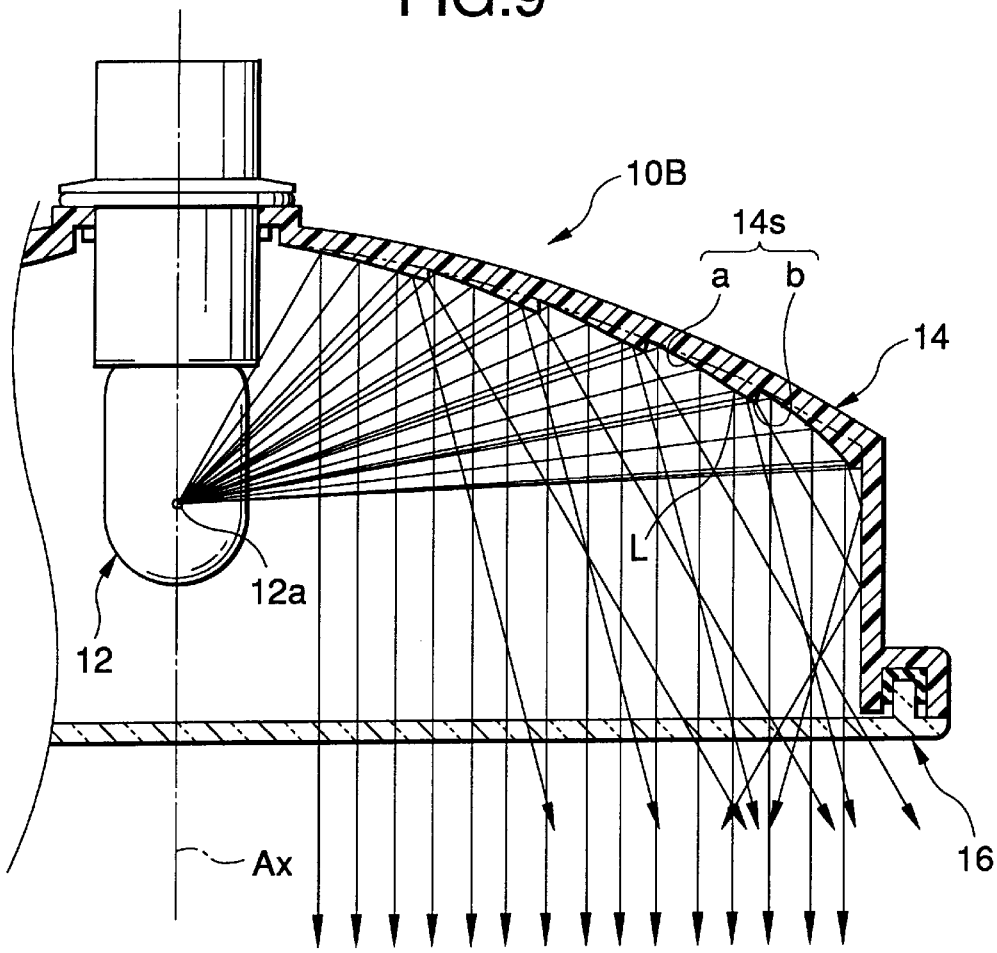
FIG. 9 is a cross-sectional view taken on line IX—IX in FIG. 8.
Figure 10:
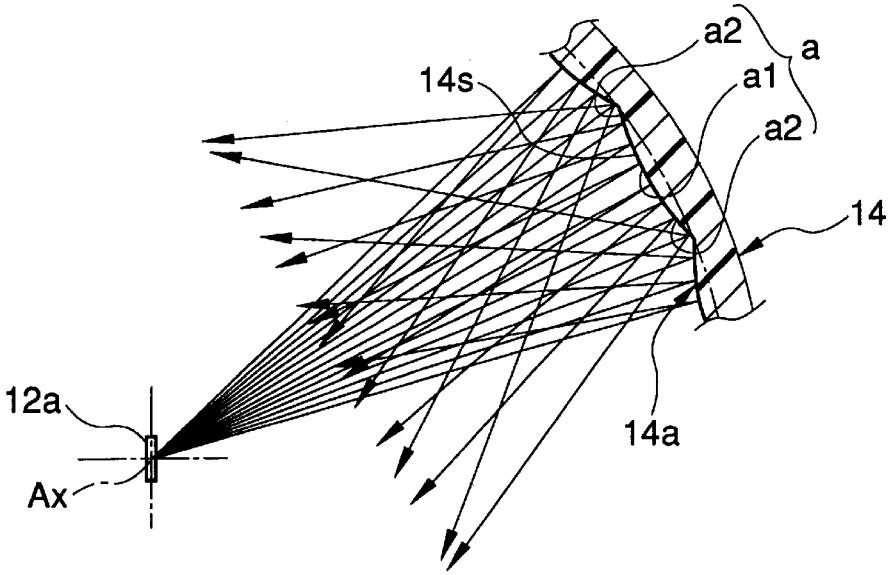
FIG. 10 is a cross-sectional view taken on line X—X in FIG. 8.

FIG. 8 is a front view showing a signal lamp for vehicles of this embodiment. FIG. 9 is a cross-sectional view taken on line IX—IX in FIG. 8. FIG. 10 is a cross-sectional view taken on line X—X in FIG. 8.

As shown in these drawings, the signal lamp 10B for vehicles of this embodiment is a circular tail lamp, the reflective surface 14*a* of the reflector 14 of which is composed of a plurality of sector-shaped diffusing reflection elements 14*s* arranged radially and concentrically at regular intervals with respect to the optical axis Ax.

In the same manner as that of the first embodiment, surface shapes of the diffusing reflection elements 14*s* are formed when the following curved surfaces are formed on a plurality of paraboloids of revolution, the focuses of which are the center of the filament 12*a*, and the focal distances of which are different from each other, wherein the central axis of each paraboloid of revolution is the optical axis Ax. The cross-sectional shape in the radial direction and the cross-sectional shape in the circumferential direction respectively correspond to the perpendicular cross-sectional shape and the horizontal cross-sectional shape in the first embodiment described before.

As shown in FIG. 10, a cross-section of each diffusing reflection element 14*s* in the circumferential direction is formed into a convex curve. Due to the foregoing, light emitting from the filament 12*a* is reflected and diffused by a predetermined diffusion angle onto both sides of the circumferential direction with respect to the direction of the optical axis Ax. In this connection, the radius of curvature of the above convex curve is set at a substantially constant value between the diffusing reflection elements 14*s*.

On the other hand, as shown in FIG. 9, the cross-section in the radial direction of each diffusing reflection element 14*s* is determined as follows. The general region "a" is set to be the same curve as that of the cross-section in the radial direction of each paraboloid of revolution, and the end region "b" located on the opposite side to the general region "a" with respect to the optical axis is set to be a convex curve which smoothly continues to the above curve of the general region "a". Due to the foregoing, light emitting from the filament 12*a* is reflected in the direction of the optical axis Ax as a flux of parallel rays in the general region "a", and reflected and diffused in a direction separating from the optical axis Ax in the end region "b".

Due to the foregoing, in each diffusing reflection element 14*s*, only light reflected in the central region a1 of the general region "a" in the circumferential direction is reflected in the direction of the optical axis Ax.

That is, the central region a1 in the transverse direction of the general region "a" becomes an optical axis direction reflecting region, and the region a2 in the general region "a" except for the central region a1 in the transverse direction and the end region "b" become an optical axis non-reflecting region.

The higher the illuminance of the diffusing reflection element with respect to the incident light emitting from the filament 12*a* is, the lower the area ratio of the optical axis direction reflecting region a1 in each diffusing reflection element 14*s* is set to be. The more distant the diffusing reflection element 14*s* is from the filament 12*a* of the light source bulb 2, the lower the value of illuminance decreases. Since the filament 12*a* is a linear light source extending in the perpendicular direction, even if the distances from the filament 12*a* are equal to each other, the value of illuminance of the diffusing reflection element 14*s* located at a position upper or lower the optical axis Ax becomes lower than the value of illuminance of the diffusing reflection element 14*s* located at the side of the optical axis.

Therefore, the area ratio of the optical axis direction reflecting region a1 of the diffusing reflection element 14*s* located at the side of the optical axis Ax is smallest and gradually becomes higher when the diffusing reflection element 14*s* is separated from the optical axis Ax. Specifically, when the boundary L between the general region "a" and the end region "b" is set at a different position according to each diffusing reflection element 14*s*, the ratio of area can be adjusted.

Next, operation of the third embodiment will be explained below.

Figure 11:
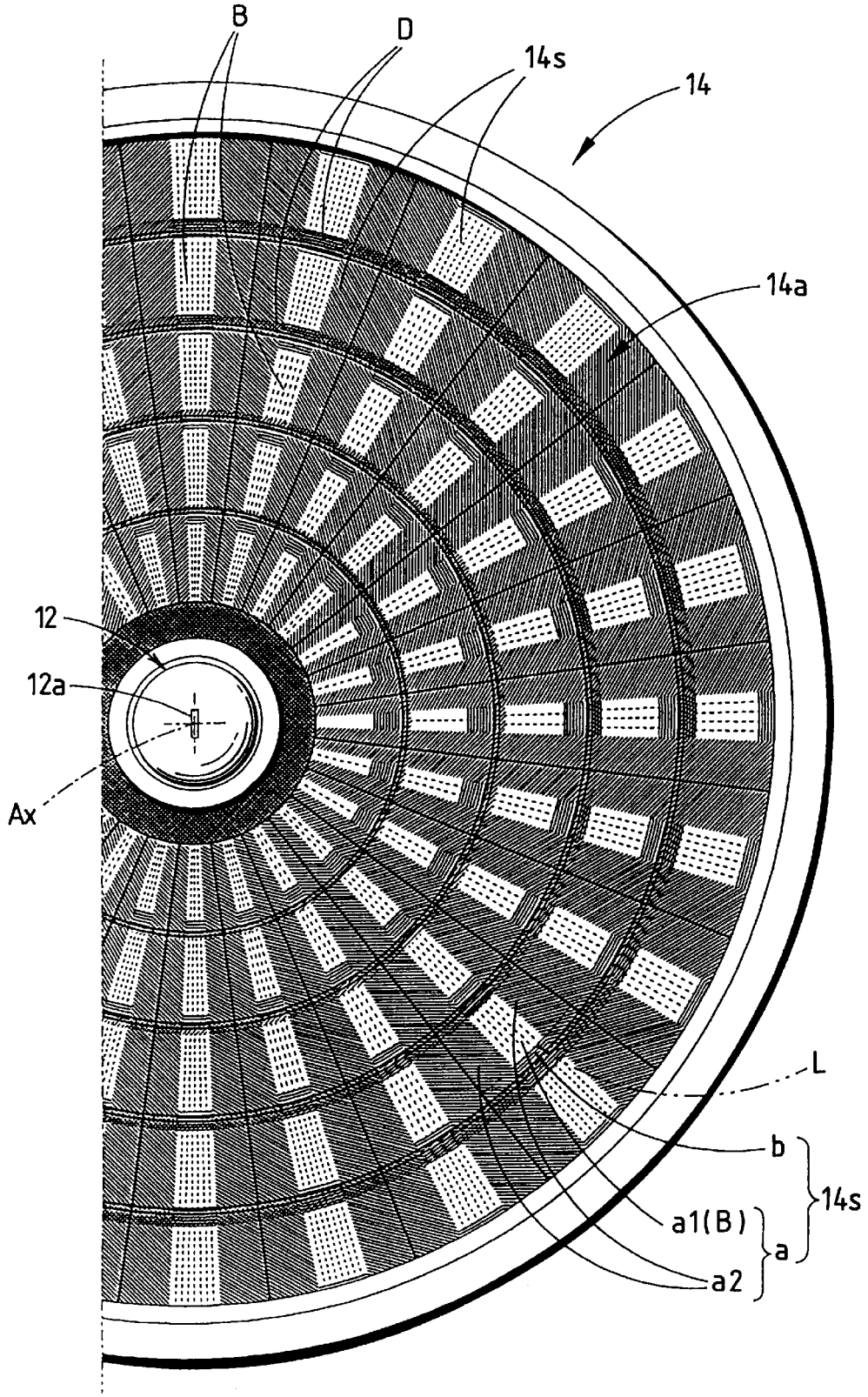
Figure 12:
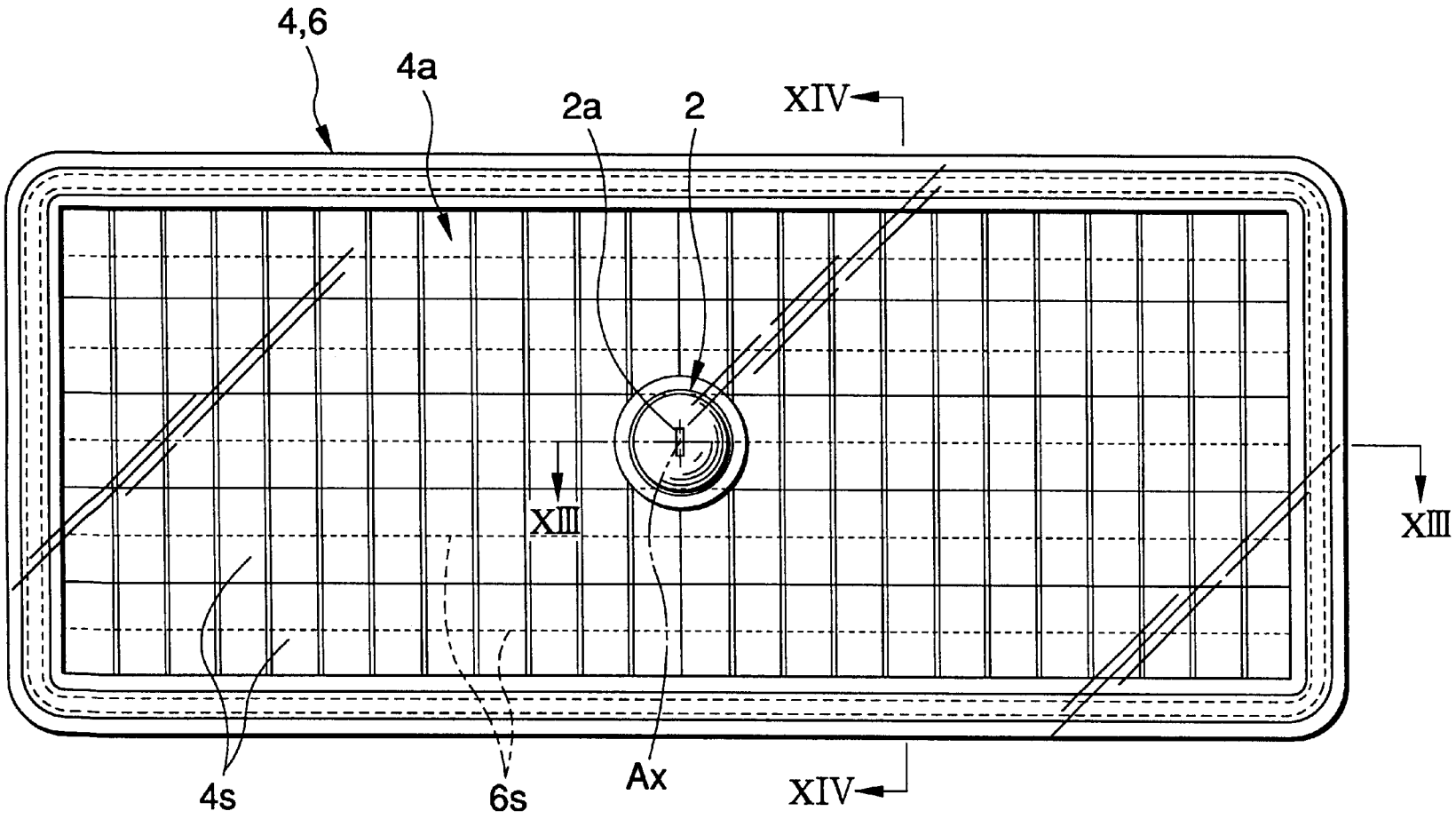
FIG. 12 is a front view showing a conventional signal lamp for vehicles.
Figure 13:
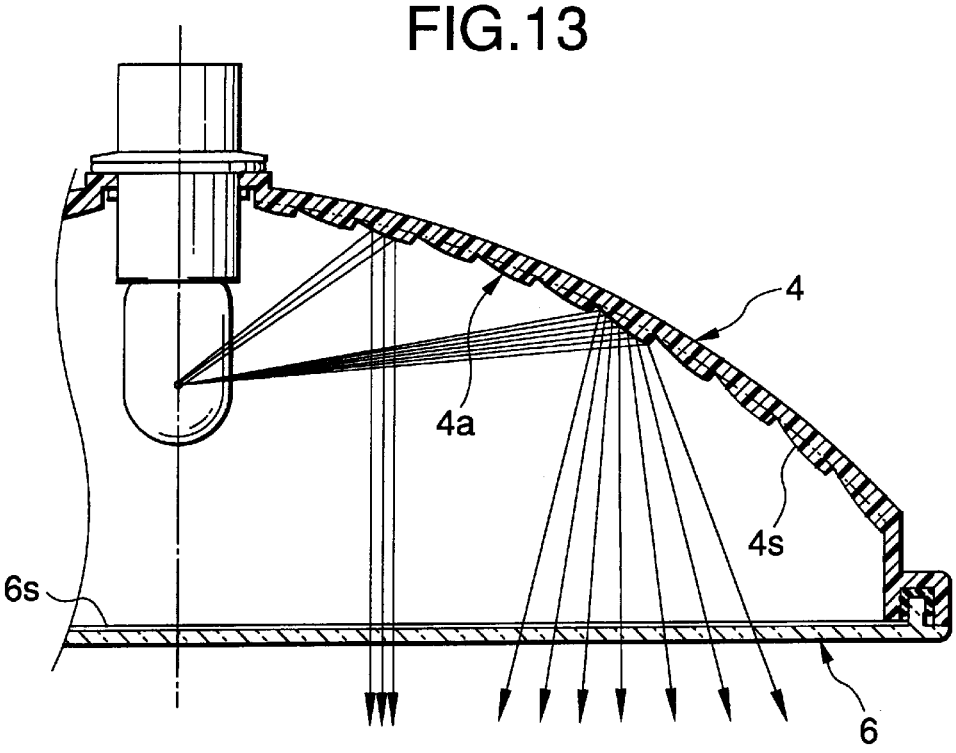
FIG. 13 is a cross-sectional view taken on line XIII—XIII in FIG. 12.
Figure 14:
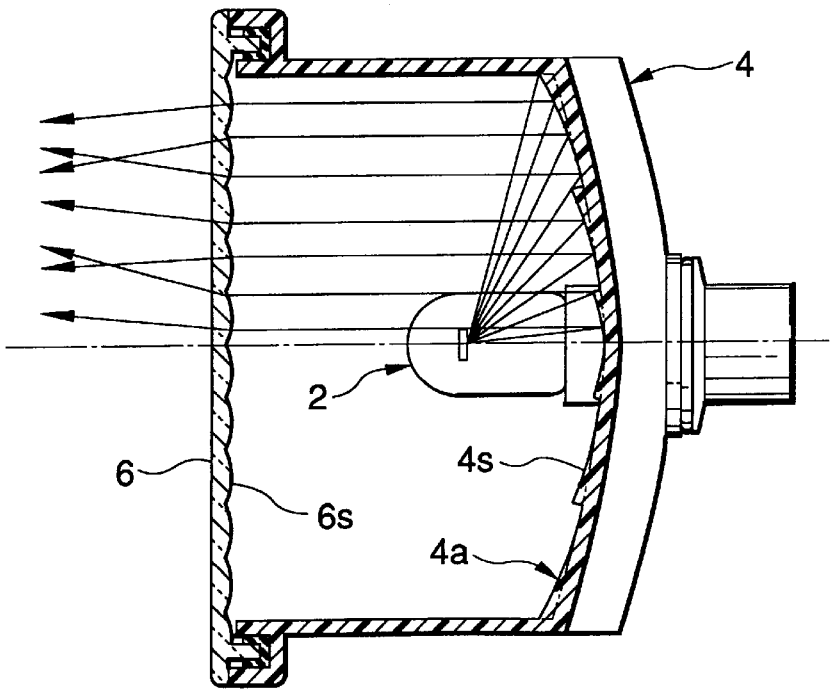
FIG. 14 is a cross-sectional view taken on line XIIV—XIIV in FIG. 12.
Figure 15:
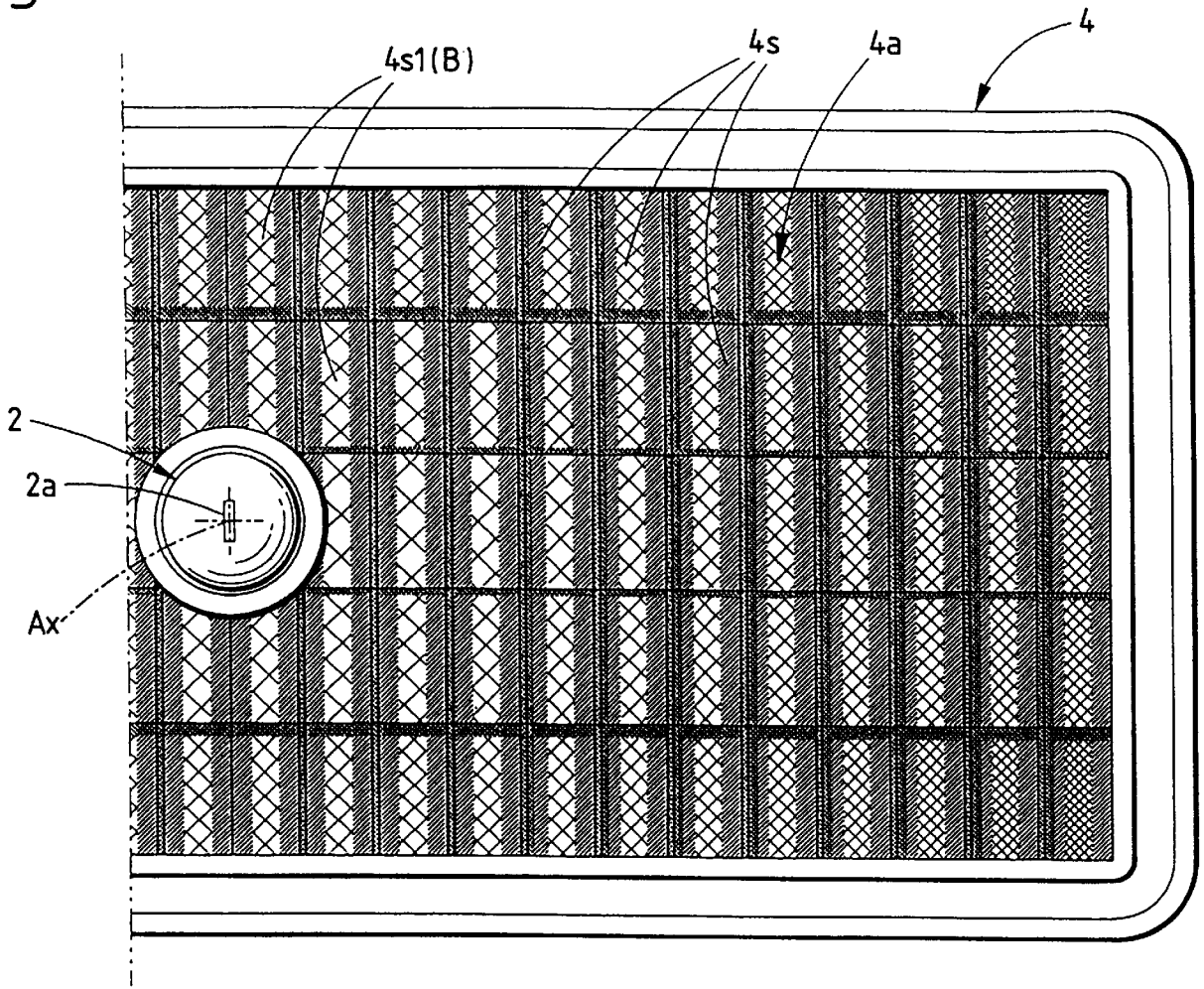
Figure 16A:
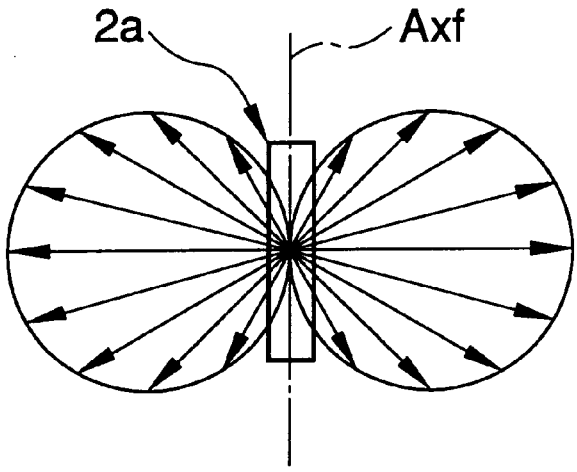
FIGS. 16(*a*) and 16(*b*) are views showing a light distribution characteristics of a linear light source.
Figure 16B:
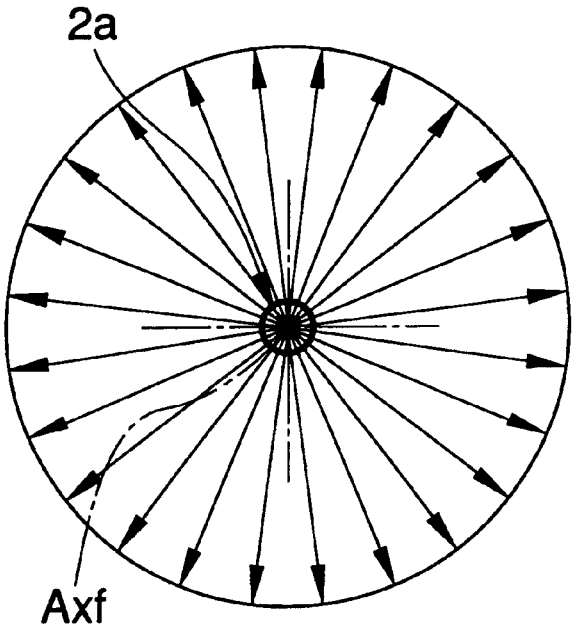

FIG. 11 is a view showing a look of the reflective surface 14*a* when the reflector 14 is observed from the front of the optical axis Ax.

As shown in the view, in each diffusing reflection element 14*s*, the optical axis direction reflecting region a1 is bright as a substantially belt-shaped bright portion B, however, the optical axis direction non-reflecting region a2 and the end region "b" are not bright. In this connection, the densely hatched concentric region D in the view is a step portion formed between the diffusing reflection elements 4*s*, and it is also a light non-incident region upon which light emitting from the filament 2*a* is not incident because of the step and the base of the light source bulb 2.

Luminance of the bright portion B is different as shown by the density of broken lines in the view according to a position at which each diffusing reflection element 14*s* is arranged. This difference in luminance corresponds to a difference in illuminance of the incident light emitting from the filament 12*a* of the light source bulb 2. Luminance of the bright portion B of the diffusing reflection element 14*s* located at the side of the optical axis Ax close to it is highest, and luminance of the bright portion B of the diffusing reflection element 14*s* distant from the optical axis Ax is gradually decreased.

However, as described before, the ratio of area of the optical axis direction reflecting region a1 of the diffusing reflection element 14*s* located at the side of the optical axis Ax is lowest and gradually increases when it is separated from it. Therefore, luminous intensity of the bright portion B is made uniform between the diffusing reflection elements 14*s*. Due to the foregoing, when the reflective surface 14*a* is observed from the front of the optical axis Ax, each diffusing reflection element 14*s* looks bright substantially uniformly.

Therefore, according to the third embodiment, in a signal lamp for vehicles, the reflective surface of which is composed of a plurality of diffusing reflection elements, it is possible to improve the external appearance of the lighting device when the light source bulb is turned on and viewed from the outside.

Further, in the third embodiment, each diffusing reflection element 14*s* has a function of diffusing in the circumferential direction, and the end region "b", has a function of diffusing in the radial direction. Therefore, it is possible for the reflector 14 to satisfy a predetermined light distribution performance required for the lighting device. Due to the foregoing, the lens 16 can be composed of a plain-glass lens, so that a feeling of transparency and depth can be enhanced.

In this embodiment, the optical axis direction reflecting region a1 composing the general region "a" of each diffusing reflection element 14*s*, and the region a2 except for that are formed by the same curved surface. Due to the above structure, not only when the lighting device is observed from the front side of the lighting device (in the optical axis Ax direction) but also even when the lighting device is observed from a visual point a little shifted from the front side of the lighting device in an arbitrary direction, the diffusing reflection elements can be seen as if they were bright at a substantially uniform brightness.

What is claimed is:

1. A signal lamp for vehicles comprising:

a light source;

a reflector having a reflective surface for reflecting forward light emitted from the light source, the reflective surface being composed of a plurality of diffusing reflection elements, each reflection element comprising a reflecting region which reflects light emitted from the light source in an optical axis direction of the reflector, where an area ratio of the reflecting region, for a particular reflection element, to a total area of said particular reflection element is based on the illuminance of said particular reflection element of said plurality of diffusing reflection elements, with respect to the incident light emitting from the light source, such that the area ratio of the reflecting region to the reflection element is lower for reflection elements with a high illuminance than for reflection elements with a low illuminance; and a lens arranged in the front of the reflector.

2. A signal lamp for vehicles according to claim 1, wherein each of the diffusing reflection elements further comprises an optical axis direction non-reflecting region in which light emitting from the light source is not reflected in the optical axis direction.

3. A signal lamp for vehicles according to claim 2, wherein a part of the optical axis direction non-reflecting region is formed into a light non-reflecting region.

4. A signal lamp for vehicles according to claim 2, wherein a part of the optical axis direction non-reflecting region is formed into a deflection diffusion reflecting region in which light emitting from the light source is diffused and reflected in a direction different from that of another region in the optical axis direction non-reflecting region.

5. A signal lamp for vehicles according to claim 3, wherein the optical axis direction reflecting region of each diffusion reflection element is composed of the same curved surface as that of the optical axis direction non-reflecting region.

6. A signal lamp for vehicles according to claim 1, wherein the diffusion reflection elements are arranged at substantially regular intervals.

7. A signal lamp for vehicles according to claim 1, wherein each of the diffusing reflection elements comprises an end region, the end region being a perpendicular section of which is formed by extending the reflection region thereof.

8. A signal lamp for vehicles according to claim 7, wherein a non-reflecting coating film is disposed on a surface of the end region of the diffusing reflection element.

9. A signal lamp for vehicles according to claim 1, wherein the diffusing reflection elements are sector-shaped and arranged radially and concentrically at regular intervals with respect to the optical axis, forming at least one paraboloid of revolution.

10. A signal lamp for vehicles according to claim 9, wherein each diffusing reflection element has a cross-section in the circumferential direction is formed into a convex curve.

11. A signal lamp for vehicles according to claim 10, wherein the radius of curvature of the convex curve of the reflection element is set at a substantially constant value between the diffusing reflection elements.

12. A signal lamp for vehicles according to claim 9, wherein each diffusing reflection element has a cross-section in the radial direction which is determined in such a manner that a first region is set to have a common curve as that of the cross-section in the radial direction of each paraboloid of revolution, and a second region located on the opposite side to the first region with respect to the optical axis which is set to be a convex curve which smoothly continues to the curve of the first region.

13. A vehicle signal lamp comprising:

a reflector having a reflective surface;

a light source which emits light on the reflective surface creating an illuminance;

a plurality of diffusing reflection elements formed on the reflective surface, each diffusing reflection element including a reflection region operative to reflect the emitted light in an optical axis direction, wherein an area of the reflection region and an area of diffusing reflection element form a ratio, which is increased as the illuminance is decreased; and a lens arranged in a front portion of the reflector.

* * * * *